US009631566B1

(12) United States Patent
Ge

(10) Patent No.: US 9,631,566 B1
(45) Date of Patent: Apr. 25, 2017

(54) PRE-CHAMBER FUEL ADMISSION VALVE DIAGNOSTICS

(71) Applicant: Caterpillar Inc., Peoria, IL (US)

(72) Inventor: Xinyu Ge, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/923,548

(22) Filed: Oct. 27, 2015

(51) Int. Cl.

| | |
|---|---|
| ***F02D 41/22*** | (2006.01) |
| ***F02D 41/00*** | (2006.01) |
| ***F02D 41/24*** | (2006.01) |
| ***F02B 77/08*** | (2006.01) |
| ***F02D 41/14*** | (2006.01) |

(52) U.S. Cl.
CPC ..... *F02D 41/2451* (2013.01); *F02B 77/085* (2013.01); *F02D 41/0087* (2013.01); *F02D 41/1498* (2013.01); *F02D 41/22* (2013.01); *F02D 2041/228* (2013.01)

(58) Field of Classification Search
CPC ..... F02D 41/2451; F02D 41/0087; F02D 41/1498; F02D 41/22; F02D 2041/228
USPC ..... 123/253, 436, 435; 701/102, 111, 112; 73/114.02
See application file for complete search history.

(56) References Cited

U.S. PATENT DOCUMENTS

| | | | | |
|---|---|---|---|---|
| 5,269,178 | A | 12/1993 | Vigmostad et al. | |
| 5,675,094 | A | 10/1997 | Klauber et al. | |
| 6,243,641 | B1 | 6/2001 | Andrews et al. | |
| 6,314,802 | B1 | 11/2001 | Wu et al. | |
| 6,651,490 | B1 | 11/2003 | Ceccarani et al. | |
| 6,739,289 | B2 | 5/2004 | Hiltner et al. | |
| 6,810,320 | B2 * | 10/2004 | Yamamoto | F02D 35/023 123/406.14 |
| 7,000,596 | B2 | 2/2006 | Zurloye et al. | |
| 7,100,567 | B1 | 9/2006 | Bailey et al. | |
| 7,117,727 | B2 | 10/2006 | Ohsaki et al. | |
| 7,117,728 | B2 | 10/2006 | Kiyomura et al. | |
| 7,257,482 | B2 | 8/2007 | Yasui | |
| 7,690,352 | B2 | 4/2010 | Zhu et al. | |
| 2009/0055074 | A1 * | 2/2009 | Ishiguro | F02D 35/023 701/102 |
| 2013/0054124 | A1 | 2/2013 | Stoll et al. | |

FOREIGN PATENT DOCUMENTS

| | | | |
|---|---|---|---|
| WO | 2014147978 | A1 | 9/2014 |

* cited by examiner

*Primary Examiner* — Mahmoud Gimie
(74) *Attorney, Agent, or Firm* — Baker Hostetler

(57) ABSTRACT

The disclosure describes systems and methods of detecting a misfire in a cylinder of an engine. Such systems and methods may include determining a standard deviation for a crank angle location in a chamber of the engine, determining a standard deviation of the peak pressure in a chamber of the engine. If the standard deviation for a crank angle location is greater than a threshold value for the standard deviation for a crank angle, or if the standard deviation for the peak pressure is greater than a threshold value for the standard deviation of the peak pressure, an engine cylinder cut out check may be performed to identify one or more misfiring cylinders.

20 Claims, 6 Drawing Sheets

PRE-CHAMBER FUEL ADMISSION VALVE DIAGNOSTICS

TECHNICAL FIELD

This disclosure relates generally to gas engines and, more particularly, to pre-chamber fuel admission valve diagnostics.

BACKGROUND

In natural gas engines, a pre-chamber is commonly associated with each cylinder. An electronic controlled fuel admission valve is used to provide fuel to the pre-chamber to facilitate the ignition of the mixture in the pre-chamber. When a solenoid in the pre-chamber fuel admission valve is energized, pressure is increased against the action of a spring force, and a pre-chamber fuel admission valve is opened. When the solenoid is de-energized, the combined forces of the spring and the force exerted by the mixture in the pre-chamber exceed the force exerted on the side remote of the pre-chamber, and the pre-chamber fuel admission valve is closed. Due to the high temperature and vibration that a pre-chamber fuel admission valve is exposed to, the pre-chamber fuel admission valve can degrade and lose certain functions after a short time of operation. Combustion residues and particulate matters in the fuel supply lines can also increase the wear of the pre-chamber fuel admission valve, which may cause the valves to leak, and consequently the cylinder to misfire.

Such leakage is a common problem for pre-chamber fuel admission valves. The leakage of pre-chamber fuel admission valves may result in a rough running of the engine and an increase in the consumption of combustion fuel. The leakage of the pre-chamber fuel valve can dramatically change the Air Fuel Ratio (AFR) in the pre-chamber, due to the smaller volume of the pre-chamber as compared to the main chamber. The AFR is precisely controlled in the pre-chamber to ensure the ignition, so when the AFR deviates from the desired value due to the pre-chamber fuel admission valve leakage, the engine may not start properly, or cause a deviation of AFR from an optimum firing range leading to a misfire in the engine. Since the engine may have a larger number of cylinders and pre-chamber fuel admission valves, and many factors can affect engine performance, it can be very time-consuming and costly to debug gas engine misfire issues in the field to find the root cause. To determine which cylinders or valves are working properly, it may not be practical or cost effective to directly measure the pre-chamber fuel admission valve movement since the tip of pre-chamber fuel admission valve is located within the pre-chamber, or by directly measuring the temperature in both pre-chamber or main chamber, as the combustion temperature can reach over 2000° C.

One example of a system and method for detecting an engine cylinder misfire is disclosed in U.S. Pat. No. 6,243,641 ("the '641 patent") to Andrews et al. The disclosed system and method includes a single gauge-type pressure sensor positioned in the exhaust manifold to detect misfires in all cylinders of an internal combustion engine. The pressure sensor detects the exhaust manifold pressure and feeds a signal to a microcomputer via an analog-to-digital converter. A data processing device monitors the pressure waveform created by the data from the sensor to determine if a full or partial misfire occurs. If a cylinder suffers from a partial or complete misfire, the strength of the pressure pulse for that cylinder will be reduced, thus, allowing the data processing device to identify the misfire. The data processing device may determine a misfire by computing an average peak pressure for each combustion cycle, a pressure threshold as a function of engine speed and fuel consumption rate, and a minimum pressure value based on the difference between the average peak pressure and the pressure threshold. The data processing device may alternatively determine a misfire by first computing a coefficient of variation between an observed pressure pulse and the average peak pressure and then comparing the coefficient of variation with a pressure threshold to determine if at least a partial misfire has occurred. However, pulsating exhaust flows from each cylinder may interfere with each other due to the overlap of exhaust valve phase. The interference of exhaust flows may limit the effectiveness of the method disclosed in the '641 patent when the method is applied to engines with large cylinders.

Accordingly, there is a need for improved pre-chamber fuel admission valve diagnostics. Various aspects of the disclosure may solve one or more of these problems and/or disadvantages.

SUMMARY

In one aspect, the disclosure describes a method of detecting a misfire in a cylinder of an engine. The method may include determining a standard deviation of a peak pressure in a chamber of the engine, and determining a standard deviation for a crank angle location. In certain aspects the method may include determining if the standard deviation for the peak pressure is greater than a threshold value for the standard deviation of the peak pressure, determining if the standard deviation for a crank angle location is greater than a threshold value for the standard deviation for a crank angle; and performing an engine cylinder cut out check.

In another aspect, the disclosure describes an engine control module configured to detect a misfire in a cylinder of an engine. The engine control module may include a memory containing predetermined calibration parameters. In some aspects, the engine control module may be programmed to determine if the engine is operating in a steady state condition, determine if the engine is operating within a predetermined range of a set of calibration parameters for the engine, and initiate a first detection mode, if the engine is operating in the steady state condition and the engine is operating within the predetermined range of the set of calibration parameters. When the ECM is in the first detection mode, the engine control module is configured to calculate a standard deviation for a crank angle location, and the engine control module may be configured to determine if the standard deviation for a crank angle location is greater than a threshold value for the standard deviation for a crank angle. When the ECM is in the first detection mode, the engine control module may be configured to calculate a standard deviation of the peak pressure in a chamber of the engine. In certain aspects, the engine control module may be programmed to determine if the standard deviation for the peak pressure is greater than a threshold value for the standard deviation of the peak pressure, and initiate a second detection mode of an engine cylinder cut out check, if the standard deviation for a crank angle location is greater than a threshold value for the standard deviation for a crank angle, or the standard deviation for the peak pressure is greater than a threshold value for the standard deviation of the peak pressure.

In yet another aspect, the disclosure describes a system for detecting a misfire in a cylinder of an engine, including an engine, a plurality of cylinders located in the engine, a pre-chamber coupled to the cylinder, a fuel delivery valve coupled to the pre-chamber. The controller may be configured to determine if the engine is operating in a steady state condition, determine if the engine is operating within a predetermined range of a set of calibration parameters for the engine, and initiate a first detection mode, if the engine is operating in the steady state condition and the engine is operating within the predetermined range of the set of calibration parameters. When the controller is in the first detection mode, the controller may be configured to calculate a standard deviation for a crank angle location in a chamber of the engine, and the controller is configured to determine if the standard deviation for a crank angle location is greater than a threshold value for the standard deviation for a crank angle. When the controller is in the first detection mode, the controller may further be configured to calculate a standard deviation of a peak pressure in a chamber of the engine, and determining if the standard deviation for the peak pressure is greater than a threshold value for the standard deviation of the peak pressure. A second detection mode of an engine cylinder cut out check may be initiated, if the standard deviation for a crank angle location is greater than a threshold value for the standard deviation for a crank angle, or the standard deviation for the peak pressure is greater than a threshold value for the standard deviation of the peak pressure. In some aspects, the controller may be configured to identify one or more misfiring cylinders of the plurality of cylinders.

Further and alternative aspects and features of the disclosed principles will be appreciated from the following detailed description and the accompanying drawings. As will be appreciated, the systems and methods disclosed herein are capable of being carried out in other and different aspects, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
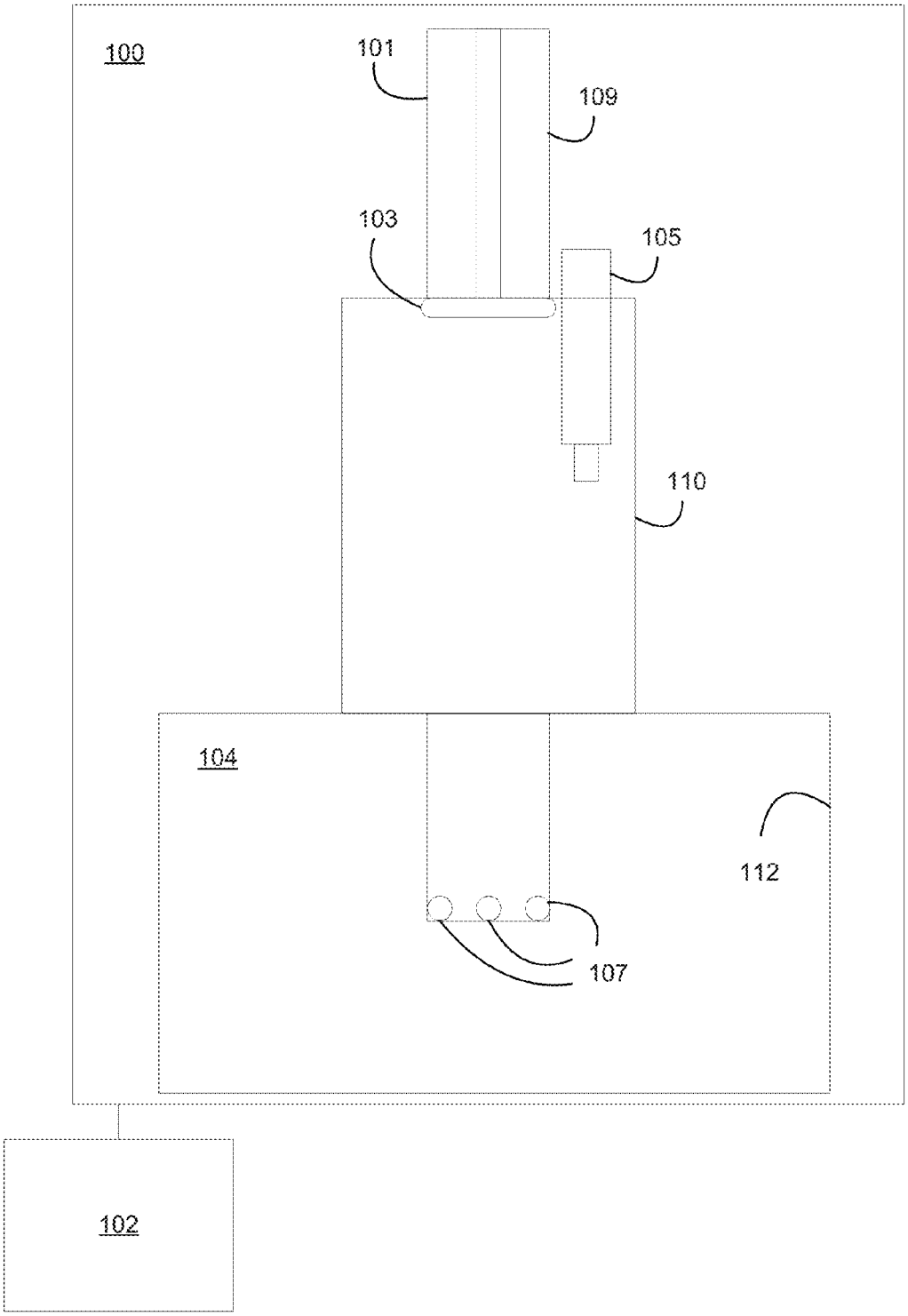
FIG. 1 illustrates a schematic sectional view of a pre-chamber of an engine according to an aspect of the disclosure.

Now referring to the drawings, wherein like reference numbers refer to like elements, there are illustrated systems and methods for detecting a misfire in a cylinder of an engine. Any numerical values recited herein are by way of illustration only. In other aspects, other values may be used, and the values can be varied in any fashion as appropriate to the application.

An exemplary aspect of the disclosure provides a method for detecting a misfire in a cylinder of an engine including determining a standard deviation for a peak pressure and an actual peak pressure in a pre-chamber or a main chamber of an engine to initially detect if there is a problem, such as a cylinder misfire. If such a problem exists, then an engine cylinder cut out check may be used to determine which cylinder is malfunctioning. The cut out check can be performed by (1) cutting out a cylinder (e.g., stopping the cylinder from producing power) while maintaining a constant engine power, and comparing the resulting increase in fuel needed in the remaining cylinders to maintain a constant engine power, or (2) cutting out a cylinder while maintaining a constant level of fuel provided, and comparing the resulting power output reduction of the engine.

FIG. 1 illustrates a schematic sectional view of a pre-chamber assembly 101 of an engine 100 according to an aspect of the disclosure. In certain aspects, the pre-chamber assembly 101 may have a pre-chamber fuel admission valve 103 (e.g., a check valve) which may be used to ensure accurate control and consistency of pre-chamber fuel delivery in the engine 100. An engine control module (ECM) 102 (e.g., a controller) may control various aspects of the engine including the pre-chamber fuel admission valve 103 and the ignition device 105. The electronic controlled pre-chamber fuel admission valve 103 may be located in a fuel line 109, which can introduce fuel into the pre-chamber 110. In some aspects, the ignition device 105 (e.g., a spark plug) may protrude into the pre-chamber 110 to ignite the fuel in the pre-chamber 110. The pre-chamber assembly 101 may have multiple orifices 107 that connect the main chamber 104 and pre-chamber assembly 101, which cause the ignited fuel to travel quickly through the orifices 107 to ignite the fuel in the main chamber 104 of the cylinder 112. The orifices 107 also may quench the jets of flame produced as they pass through the orifices 107.

The ECM 102 may be configured to monitor a specific set of calibration parameters and engine operating conditions, such as a fuel quantity, rail pressure, desired Exhaust Gas Recirculation (EGR) ratio, and ignition timing. When the engine runs at a steady state condition, the ECM 102 may refer to engine calibration maps or reference tables to obtain predetermined calibration values corresponding to the calibration parameters. These calibration maps or reference tables may be set during the engine calibration process and stored in a memory of the ECM 102. In certain aspects, the ECM 102 may be configured to determine when the measured calibration parameters are substantially close to the corresponding predetermined calibration values, within about +/−3% for example. This range may also be referred to as a measurement window, and may be used to ensure the engine is not operating in extreme conditions, such as an excavator in the process of digging, for example, so that the tests disclosed herein may be conducted under normal operating conditions.

Figure 2:
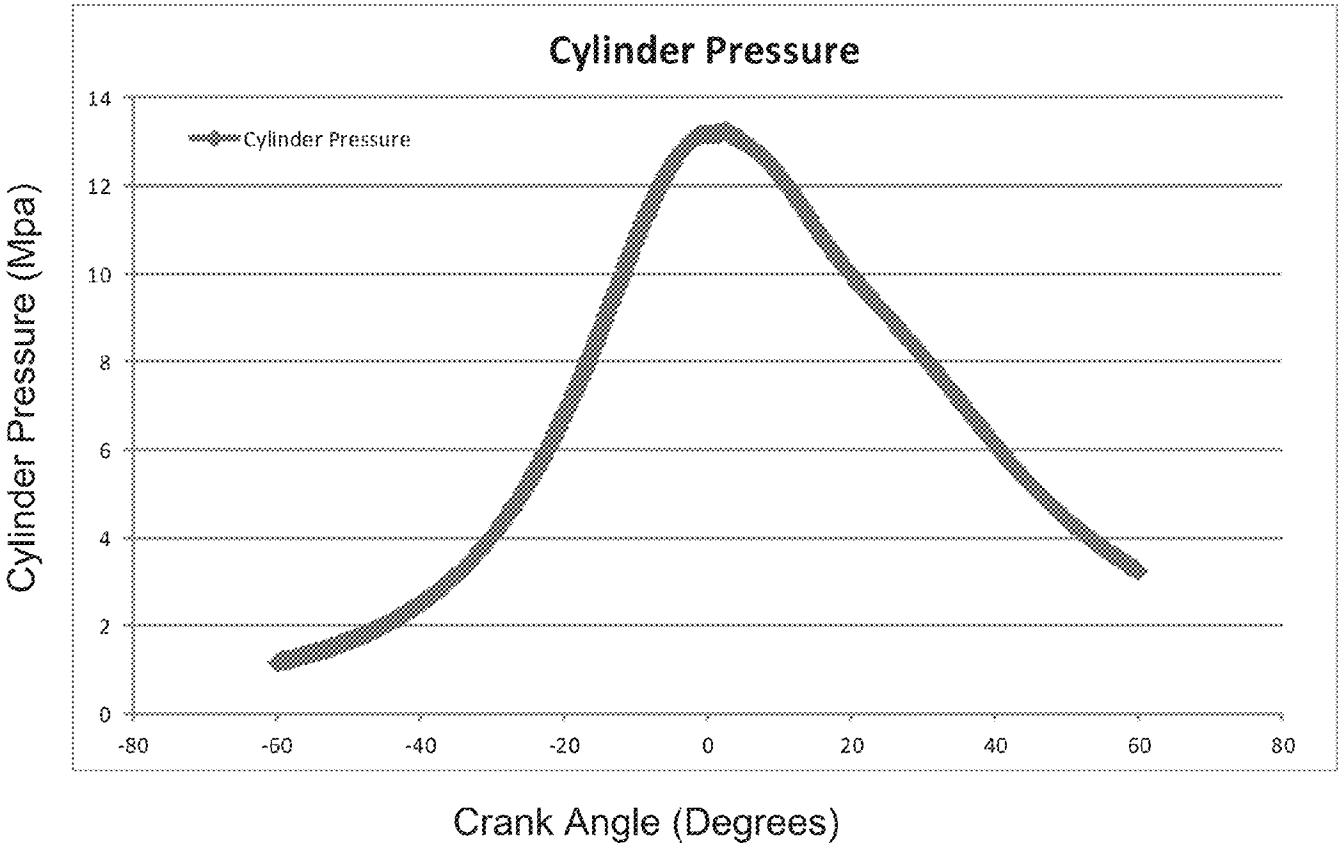
FIG. 2 illustrates a plot of the pre-chamber pressure versus the corresponding location in terms of crank angle according to an aspect of the disclosure.

FIG. 2 illustrates a plot of the pre-chamber pressure versus the corresponding location in terms of crank angle according to an aspect of the disclosure. When the engine operates within the measurement window, pressures for each cylinder at a series of discrete crank angles may be recorded over a certain time period or number of cycles (e.g., 5 minutes or 1000 cycles). The peak pressure in each combustion cycle can be determined by selecting the maximum pressure value or the maximum filtered pressure value in the individual combustion cycle. The crank angle location corresponding to the peak pressure can be determined for each combustion cycle as well. The combustion consistency at the engine system level may then be checked by determining the standard deviation of the crank angle location corresponding to the pre-chamber peak pressure, and by determining the standard deviation of the pre-chamber peak pressure over certain combustion cycles. One example of determining may be to calculate. The determined standard deviations are then compared to standard deviation threshold values that were determined during the engine calibration process. In an aspect, FIG. 2 may represent data points collected for pressure and crank angle at a sampling rate of 100 Hz, for example.

In some aspects, if a pre-chamber pressure reading is not available, a main chamber 104 pressure can also be used to perform the standard deviation calculations. These pressures can either be directly measured or estimated by a neural network (e.g., a virtual sensor).

In FIG. 2, the pre-chamber peak pressure for a cylinder is shown according to the corresponding crank angle location in degrees. The point on the line at 2.7 degrees crank angle in FIG. 2 corresponds to the peak pressure in a cylinder. For example, at 2.7 degrees crank angle, the pressure in the cylinder is 13.251 MPa. In some aspects, other similarly functional cylinders in the same engine may have similar pressures at corresponding crank angles. In certain aspects, other cylinders in the same engine may exhibit different pressures at corresponding crank angles, due to defective operations or conditions, such as misfiring, for example. The standard deviations of a particular pressure or crank angle may then be determined for each cylinder and then compared to the standard deviation threshold values for the pressure or crank angle from an engine calibration map or reference table.

This procedure of determining when the calibration parameters are substantially close to corresponding predetermined calibration values from the engine calibration process to initiate the measurement of cylinder pressure and crank angle, and determining the standard deviations and comparing them to standard deviation threshold values may be referred to as a first detection mode. In an exemplary aspect, if at least one of the determined standard deviations is greater than its corresponding predetermined standard deviation threshold value, the ECM 102 may then initiate a second detection mode of an engine cylinder cut out check.

Figure 3:
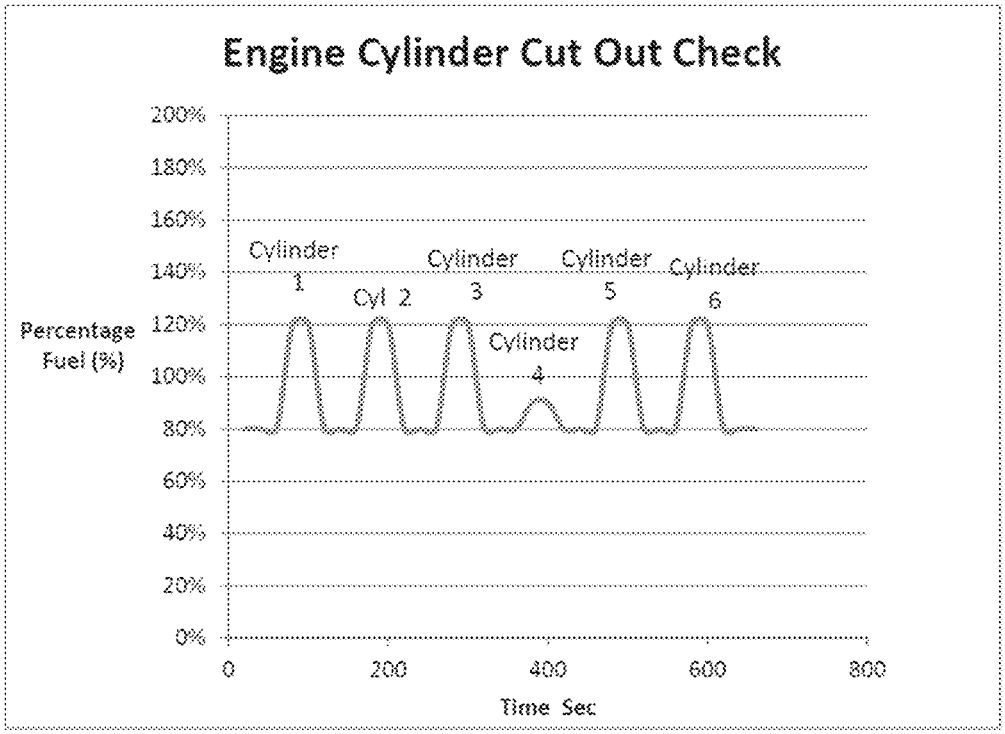
FIG. 3 illustrates a graph of an engine cylinder cut out check according to an aspect of the disclosure.

FIG. 3 illustrates a graph of an engine cylinder cut out check according to an aspect of the disclosure. In FIG. 3, the test results for an engine cylinder cut out check are shown, where the percentage of fuel delivered to the engine to maintain a constant power is plotted versus time (in seconds). Each cylinder number identified in FIG. 3 corresponds to a time when the identified cylinder is being tested, by cutting the power contribution for that cylinder, and recording the resulting data from the engine.

In an engine cylinder cut out check, the ECM 102 may be configured to command the engine to operate at a part load condition (e.g., at 800 rpm and a 50% load condition) or a low idle condition. In certain aspects, the ECM 102 may then test each cylinder by stopping a cylinder from functioning, and then recording engine data such as the percentage of fuel used while the remaining cylinders are functioning to maintain the same engine speed and load/torque. The engine power may be maintained constant by increasing fuel delivery to other cylinders which are still firing. In some aspects, the cylinders may be cut out or stopped by ceasing fuel delivery or by not initiating a spark in the cylinder's pre-chamber. Each cylinder may be tested in a sequential manner over a certain time period.

In FIG. 3 each of six cylinders is cut out individually over an amount of time. As shown, cylinder 1 is cut out from about 60 seconds to 140 seconds, cylinder 2 is cut out from about 160 seconds to 240 seconds, cylinder 3 is cut out from about 260 seconds to 340 seconds, cylinder 4 is cut out from about 360 seconds to 440 seconds, cylinder 5 is cut out from about 460 seconds to 540 seconds, and cylinder 6 is cut out from about 560 seconds to 640 seconds. As shown in FIG. 3, for example, when cylinder 1 is cut out, the fuel delivery to the engine increases from about 80% to 120% to maintain the engine power. When a cylinder is cut out, the engine total power is produced from the other five cylinders remaining. In order to maintain the same engine power, the other five cylinders have to produce at a higher power than when in a normal operating condition.

The ECM 102 may be configured to cut out cylinders in a defined sequence, such as cylinder 1-2-3-4-5-6, for example, as seen in FIG. 3. When testing a particular cylinder, that cylinder is cut out, while the remaining cylinders remain operating. At the completion of the test for a particular cylinder, that cylinder may be reactivated before the next cylinder is cut out, such that only one cylinder is cut out at a time. If every cylinder runs properly, it contributes an equal portion of the total power. The outlier (e.g., misfiring) cylinder can be identified where, when a cylinder is cut out, only a smaller fuel increase in fuel to the remaining cylinders is needed to maintain constant power from the engine (see cylinder 4 in FIG. 3). In FIG. 3, the cylinders 1, 2, 3, 5, and 6 are likely performing properly (or at least performing equal to each other), as when one of them is cut out the percentage fuel increase is the same for each cylinder tested (e.g. from about 80% to 120% as seen in FIG. 3).

However, the curve for cylinder 4 in FIG. 3 indicates that cylinder 4 produces less power compared to other cylinders, and thus may be misfiring. When cylinder 4 is cut out, the percentage of fuel increase to the engine is from about 80% to 90%. The relatively small amount of fuel increase needed to maintain the engine power when cylinder 4 was cut out indicates that the other cylinders did not have to compensate much for the loss of cylinder 4, meaning cylinder 4 was not doing as much work when it was active as compared to the other cylinders. Thus, since the percentage of fuel increase needed when cylinder 4 was cut out is smaller than the percentage of fuel increase needed when the other cylinders were cut out, cylinder 4 can be identified as the outlier cylinder and reported to a user (e.g., operator of the engine or driver of the vehicle).

When a load sensor or sensors are used, the cylinder cutout test can be performed at the part load condition, and the engine can still provide a certain level of useful power to avoid downtime. In other aspects, when the cylinder cutout test is performed at a low idle condition, the parasitic force on the engine is only the demanded torque (power), and no load sensor information is required.

Figure 4:
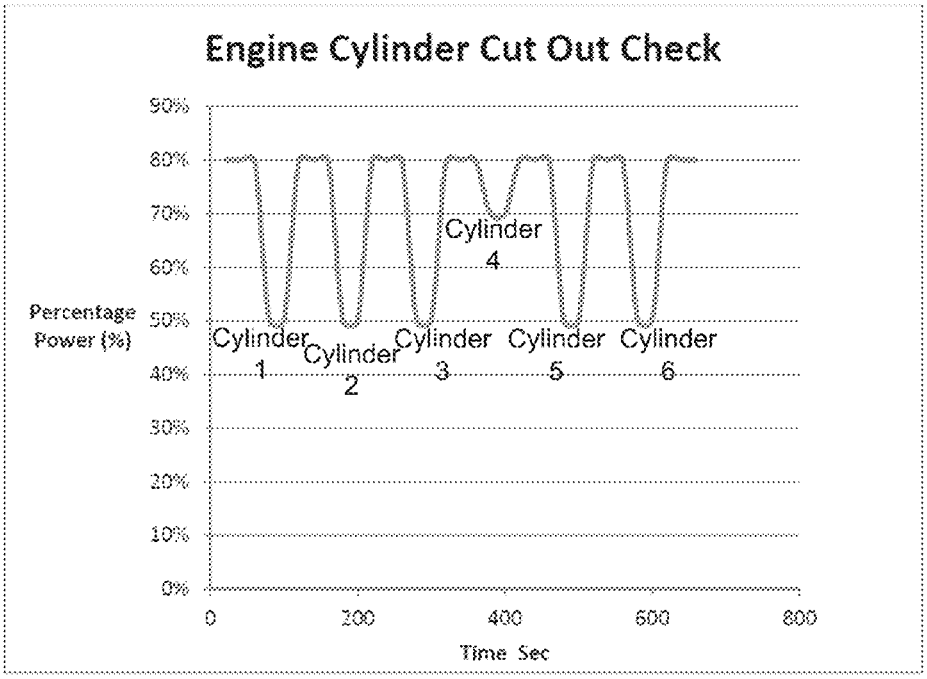
FIG. 4 illustrates a graph of an engine cylinder cut out check according to another aspect of the disclosure.

FIG. 4 illustrates a graph of an engine cylinder cut out check according to another aspect of the disclosure. In FIG. 4, the test results for an engine cylinder cut out check are shown, where the percentage of power output from the engine is plotted versus time (in seconds). Each cylinder number identified in FIG. 4 corresponds to a time when the identified cylinder is being tested, by cutting the power contribution for that cylinder, and recording the resulting data from the engine.

Like the engine cut out check of FIG. 3, the ECM 102 is configured to cut out cylinders in a defined sequence, for example, in the order of cylinders 1-2-3-4-5-6. If every cylinder runs properly, it will contribute an equal portion of the total power according to the engine design. To check the cylinders, the ECM 102 may be configured to provide a constant fuel flow to the main chamber 104 and pre-chamber of each cylinder. Then, the ECM 102 may stop the function of the cylinder under test by deactivating pre-chamber fuel delivery valve to cut the fuel to the pre-chamber, or by not initiating spark in the pre-chamber of the cylinder. Since the fuel flow to main chamber 104 is constant, the power will drop when a cylinder is cut out. An outlier or misfiring cylinder can be identified by monitoring the power or load drop of the total engine output power. By checking the percentage drop of total engine output power or turbo speed, a misfiring cylinder can be identified during the engine cut out check. The outlier is identified by comparing the cut out check output (e.g., the percentage of engine power at a constant fuel flow when a cylinder is cut out as seen in FIG. 4) for each cylinder to the mean percentage power output of the engine either when no cylinder is cut out.

For example, as seen in FIG. 4, when cylinder 1 is cut out, the percentage of power produced by the engine decreases from about 80% to about 50%. However, when cylinder 4 is cut out, the percentage of power produced by the engine decreases only from about 80% to about 70%. In FIG. 4, the mean percentage of power produced by the engine when all of the cylinders are operating is about 80%, however, when cylinders 1-3, and 5-6 are each cut out, the percentage of power produced by the engine drops to about 50%, while when cylinder 4 is cut out, the percentage of power produced by the engine is about 70%. Thus, since the percentage of power drop when cylinder 4 was cut out is smaller than the percentage of power drop when the other cylinders were cut out, cylinder 4 can be identified as the outlier cylinder and reported to a user.

In some aspects, the fuel valve diagnosis can be performed within about 10-30 minutes, although that time may depend on the engine configuration, such as the number of cylinders being tested. The cylinder cut out check may be performed on engines with any number of cylinders (e.g., 6 cylinders to 32 cylinders). In certain aspects, the load sensor may be a pressure sensor associated with one or more implement cylinders (e.g., a boom cylinder, a stick cylinder, or a bucket cylinder). In another aspect, load sensor may be a mechanical load cell strategically placed between mating mechanical components of machine, or a virtual sensor (e.g. an estimation according to the voltage and amperes in an Electric Power Generation Application). In some aspects, a turbo speed can be used as an indicator in place of a load sensor.

INDUSTRIAL APPLICABILITY

The disclosed systems and method of detecting a misfire in a cylinder of an engine may be applicable to any application of an engine containing cylinders. The system and method of pre-chamber fuel admission valve diagnostics of this disclosure may be used in a stand-alone engine, for example, or in an engine that may be coupled to a machine (not shown). In some aspects, the machine can be an "over-the-road" vehicle such as a truck or may be any other type of machine that performs some type of operation associated with an industry such as mining, construction, farming, transportation, or any other industry known in the art. For example, the machine may be an off-highway truck, earth-moving machine, such as a dump truck, excavator, front loader, or the like.

Figure 5:
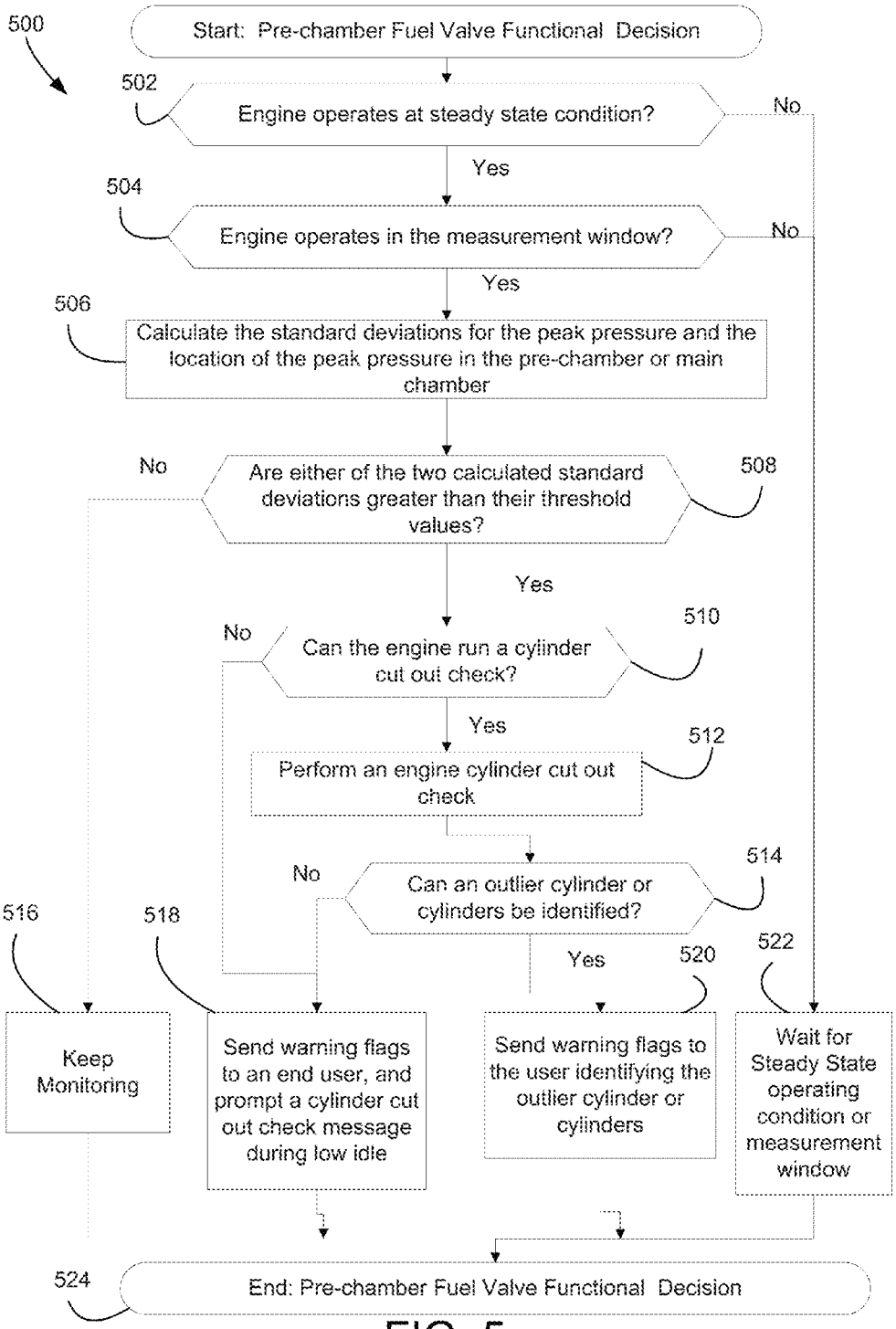
FIG. 5 illustrates a flow chart of a software algorithm used to detect a misfire in a cylinder of an engine according to an aspect of the disclosure.

FIG. 5 illustrates a flow chart of a software algorithm used to detect a misfire in a cylinder of an engine according to an aspect of the disclosure. The process 500 begins in block 502, where the ECM determines if the engine is operating in a steady state condition. If the engine is not operating in a steady state condition, the process 500 proceeds to block 524 where the ECM will wait for the engine to be operating in a steady state condition. Conversely, if the engine is operating in a steady state condition, the process 500 proceeds to block 504, where the ECM then determines if the engine is operating in the measurement window. If the engine is not operating in the measurement window, the process 500 proceeds to block 522 where the ECM may wait for the engine to be operating in the measurement window. However, if instead the engine is operating in the measurement window, the process 500 proceeds to block 506, where the ECM may calculate the standard deviation for the peak pressure and the location of the peak pressure in either the pre-chamber 110 or the main chamber 104. Then in block 508 each determined standard deviation is compared to standard deviation threshold values. If neither determined standard deviation is greater than the threshold values, the process 500 proceeds to block 516 to continue monitoring. However, if either determined standard deviation is greater than its threshold value, the process 500 proceeds to block 510 where the ECM determines if a cylinder cut out check can be performed. If the cylinder cut out check cannot be performed, due to heavy load conditions for example, the process 500 will proceed to block 518 where a warning may be sent to a user and the test may be attempted during the next period of low idle.

Instead, if the cut out check can be performed, the process 500 proceeds to block 512 to perform the test. The ECM 102 then checks if an outlier cylinder or cylinders can be identified in block 514. If no outlier cylinder can be identified, the process 500 proceeds to block 518 where a warning may be sent to a user and the test may be attempted during the next period of low idle. On the other hand, if the outlier cylinder or cylinders can be identified, the process 500 may proceed to block 520 where a warning may be sent to the user identifying the defective cylinders. The process 500 then proceeds to block 524 where it may be repeated any number of times.

Figure 6:
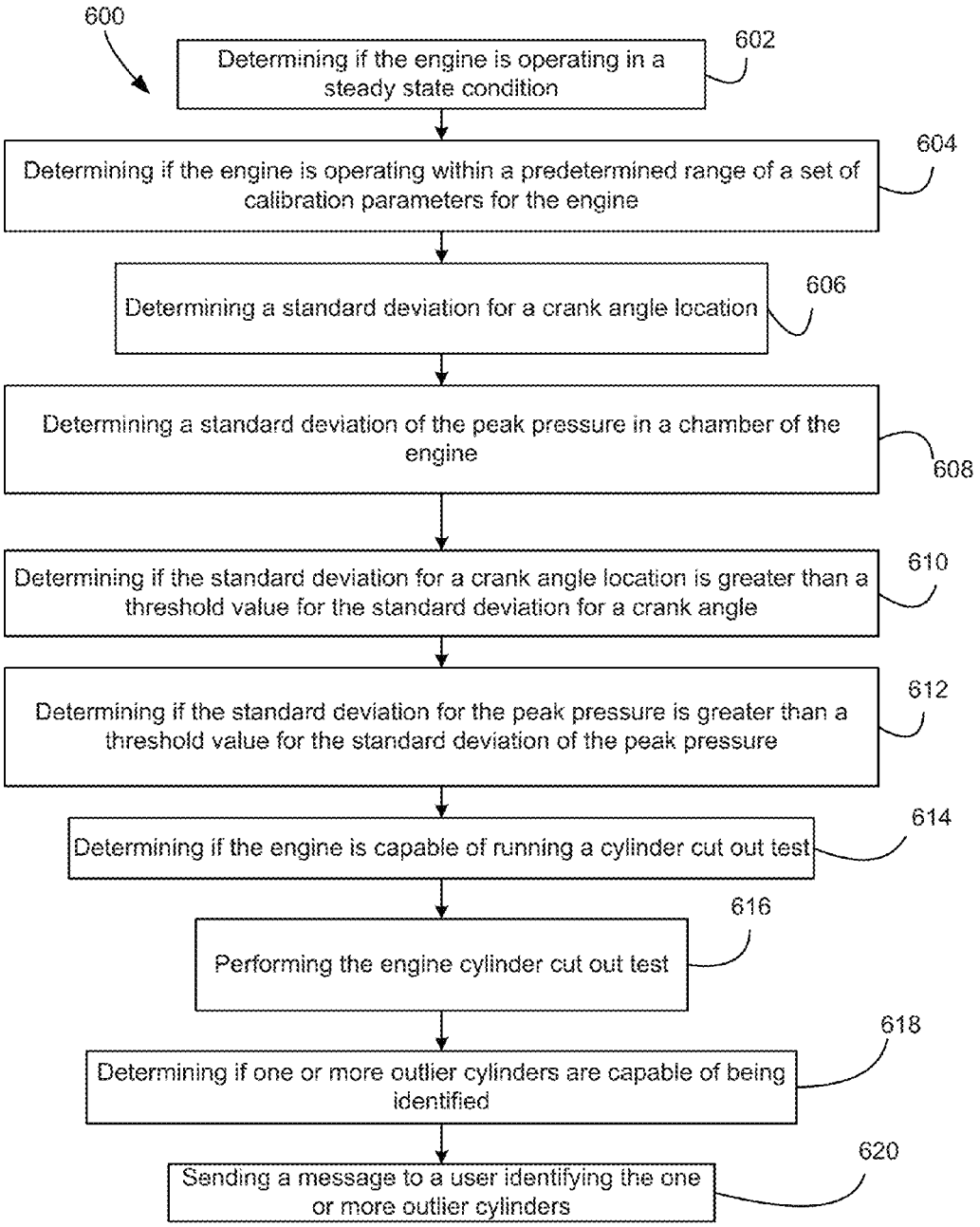
FIG. 6 illustrates a method of detecting a misfire in a cylinder of an engine according to an aspect of the disclosure.

FIG. 6 illustrates a method of detecting a misfire in a cylinder of an engine according to an aspect of the disclosure. The method 600 of detecting a misfire in a cylinder of an engine may include a block 602 of determining if the engine is operating in a steady state condition. If the engine is operating in a steady state condition, at block 604 the method 600 may then determine if the engine is operating within a predetermined range of a set of calibration parameters for the engine. In block 606, a standard deviation for a crank angle location relative to a peak pressure in a chamber of the engine is determined, if the engine is operating in the steady state condition and the engine is operating within the predetermined range of the set of calibration parameters for the engine. Likewise, in block 608, a standard deviation of the peak pressure in a chamber of the engine relative to the crank angle location is determined, if the engine is operating in the steady state condition and the engine is operating within the predetermined range of the set of calibration parameters for the engine.

The method 600 may then determine if the standard deviation for a crank angle location relative to a peak pressure is greater than a threshold value for the standard deviation for a crank angle in block 610. In block 612, the method 600 may determine if the standard deviation for the peak pressure is greater than a threshold value for the standard deviation of the peak pressure. In certain aspects, the method 600 may determine if the engine is capable of running a cylinder cut out check at a present time in block 614, if the standard deviation for a crank angle location relative to a peak pressure is greater than a threshold value for the standard deviation for a crank angle, or the standard deviation for the peak pressure is greater than a threshold value for the standard deviation of the peak pressure. If the engine is capable of running a cylinder cut out check, the engine cylinder cut out check may then be performed in block 616. In block 618, the method 600 may determine if one or more outlier cylinders are capable of being identified from the engine cylinder cut out check. If one or more outlier cylinders are capable of being identified, a message may be sent to an user identifying the one or more outlier cylinders.

The ECM 102 may be configured to receive information regarding machine operating parameters and/or for monitoring, recording, storing, indexing, processing, and/or communicating such information. In certain aspects, the ECM 102 may include components such as, for example, a memory, one or more data storage devices, a central processing unit, or any other components that may be used to run an application.

Although aspects of the present disclosure may be described generally as being stored in memory, one skilled in the art will appreciate that these aspects can be stored on, or read from, types of computer program products or computer-readable media, such as computer chips and secondary storage devices, including hard disks, floppy disks, optical media, CD-ROM, or other forms of RAM or ROM. Various other known circuits may be associated with ECM 102, such as power supply circuitry, signal-conditioning circuitry, solenoid driver circuitry, communication circuitry, and other appropriate circuitry.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. A method of detecting a misfire in a cylinder of an engine comprising the steps of:

determining a standard deviation of a peak pressure in a chamber of the engine;

determining a standard deviation for a crank angle location;

determining if the standard deviation for the peak pressure is greater than a threshold value for the standard deviation of the peak pressure;

determining if the standard deviation for a crank angle location is greater than a threshold value for the standard deviation for a crank angle; and performing an engine cylinder cut out check.

2. The method of claim 1, further comprising the step of:

identifying one or more misfiring cylinders.

3. The method of claim 2, further comprising the steps of:

determining if the engine is operating in a steady state condition; and determining if the engine is operating within a predetermined range of a set of calibration parameters for the engine.

4. The method of claim 3, wherein the step of determining a standard deviation for a crank angle location is performed if the engine is operating in the steady state condition and the engine is operating within the predetermined range of the set of calibration parameters for the engine.

5. The method of claim 4, wherein the step of determining a standard deviation of the peak pressure is performed if the engine is operating in the steady state condition and the engine is operating within the predetermined range of the set of calibration parameters for the engine.

6. The method of claim 5, wherein the step of performing an engine cylinder cut out check is performed if the standard deviation for a crank angle location is greater than a threshold value for the standard deviation for a crank angle, or the standard deviation for the peak pressure is greater than a threshold value for the standard deviation of the peak pressure.

7. The method of claim 6, further comprising the step of:

determining if the engine is capable of running a cylinder cut out check.

8. The method of claim 7, further comprising the step of:

sending a warning message to a user and initiate the cylinder cut out check when the engine is operating at a low idle if the engine is not capable of running a cylinder cut out check at a present time.

9. The method of claim 8, further comprising the step of:

sending a warning message to the user and initiate the cylinder cut out check when the engine is operating at a low idle if no misfiring cylinders have been identified.

10. The method of claim 9, further comprising the step of:

sending a message to an user identifying the one or more misfiring cylinders, if one or more misfiring cylinders have been identified.

11. The method of claim 10, wherein the chamber is a pre-chamber of the engine.

12. The method of claim 10, wherein the chamber is a main chamber of the engine.

13. The method of claim 10, wherein the cylinder cut out check is performed by maintaining a constant power output of the engine;

stopping a power output of a cylinder under test;

monitoring a fuel increase needed to maintain the constant power; and comparing the fuel increase needed for each cylinder under test to a mean output for all of the cylinders.

14. The method of claim 10, wherein the cylinder cut out check is performed by:

maintaining a constant fuel flow to the main chamber and pre-chamber of each cylinder;

stopping a power output of a cylinder under test;

monitoring a total engine output power; and comparing a decrease in a percent of engine output power to a mean engine output power.

15. The method of claim 13, wherein the cylinder cut out check is performed at a partial load condition.

16. An engine control module configured to detect a misfire in a cylinder of an engine, the engine control module comprising:

a memory containing predetermined calibration parameters;

the engine control module programmed to:

determine if the engine is operating in a steady state condition;

determine if the engine is operating within a predetermined range of a set of calibration parameters for the engine;

initiate a first detection mode, if the engine is operating in the steady state condition and the engine is operating within the predetermined range of the set of calibration parameters;

wherein, when the engine control module is in the first detection mode, the engine control module is configured to calculate a standard deviation for a crank angle location, and the engine control module is configured to determine if the standard deviation for a crank angle location is greater than a threshold value for the standard deviation for a crank angle; and wherein, when the engine control module is in the first detection mode, the engine control module is configured to calculate a standard deviation of a peak pressure in a chamber of the engine, and determining if the standard deviation for the peak pressure is greater than a threshold value for the standard deviation of the peak pressure; and initiate a second detection mode of an engine cylinder cut out check, if the standard deviation for a crank angle location is greater than a threshold value for the standard deviation for a crank angle, or the standard deviation for the peak pressure is greater than a threshold value for the standard deviation of the peak pressure.

17. The engine control module of claim 16, wherein during the engine cylinder cut out check, the engine control module is further configured to command the engine to operate at a partial load or a low idle condition, where the engine control module alternately turns off each cylinder in a sequence by ceasing fuel delivery to each pre-chamber by deactivating a pre-chamber fuel delivery valve or by not to initiate a spark in each pre-chamber, while maintaining an engine speed.

18. The engine control module of claim 17, wherein the engine control module is further configured to identify one or more misfiring cylinders by determining that when a first cylinder is turned off, a first fuel increase to the engine is needed to maintain a constant power, and when a second cylinder is turned off, a second fuel increase to the engine is needed to maintain a constant power, such that when the first fuel increase is less than the second fuel increase, a misfiring cylinder is identified as the first cylinder.

19. The engine control module of claim 18, wherein the engine is configured to maintain a constant power level by increasing fuel delivery to remaining cylinders of a plurality of cylinders which are still firing.

20. A system configured to detect a misfire in a cylinder of an engine, comprising:

an engine;

a plurality of cylinders located in the engine;

a pre-chamber coupled to the cylinder;

a fuel delivery valve coupled to the pre-chamber;

a controller configured to:

determine if the engine is operating in a steady state condition;

determine if the engine is operating within a predetermined range of a set of calibration parameters for the engine;

initiate a first detection mode, if the engine is operating in the steady state condition and the engine is operating within the predetermined range of the set of calibration parameters;

wherein, when the controller is in the first detection mode, the controller is configured to calculate a standard deviation for a crank angle location in a chamber of the engine, and the controller is configured to determine if the standard deviation for a crank angle location is greater than a threshold value for the standard deviation for a crank angle; and wherein, when the controller is in the first detection mode, the controller is configured to calculate a standard deviation of a peak pressure in a chamber of the engine, and determining if the standard deviation for the peak pressure is greater than a threshold value for the standard deviation of the peak pressure;

initiate a second detection mode of an engine cylinder cut out check, if the standard deviation for a crank angle location is greater than a threshold value for the standard deviation for a crank angle, or the standard deviation for the peak pressure is greater than a threshold value for the standard deviation of the peak pressure; and identify one or more misfiring cylinders of the plurality of cylinders.

* * * * *